United States Patent [19]

Lothar

[11] Patent Number: 4,807,876

[45] Date of Patent: Feb. 28, 1989

[54] LIFT/TOW ASSISTANCE DEVICE TO RELIEVE THE LOWER ARM IN SPORTING ACTIVITIES USING EQUIPMENTS

[75] Inventor: Eggerstorfer Lothar, Gräfelfing, Fed. Rep. of Germany

[73] Assignee: BHL - Sportartikel - Vertriebs GmbH, Munich, Fed. Rep. of Germany

[21] Appl. No.: 22,677

[22] Filed: Mar. 6, 1987

[30] Foreign Application Priority Data

Feb. 23, 1987 [DE] Fed. Rep. of Germany ..... 8702739

[51] Int. Cl.[4] ..... A63B 13/00

[52] U.S. Cl. ..... 272/123

[58] Field of Search ..... 272/119, 123, 143; 128/78, 134; 273/165, 166, 189 R; 224/218, 219, 221, 222, 252, 258, 268

[56] References Cited

U.S. PATENT DOCUMENTS

| | | | |
|---|---|---|---|
| 475,432 | 5/1892 | Blades | 273/189 R X |
| 2,652,050 | 9/1953 | Schoeller | 224/268 X |
| 2,877,465 | 3/1959 | Stroud | 273/166 X |
| 3,541,990 | 11/1970 | Du Mas | 272/123 X |
| 3,963,156 | 6/1976 | Perrin | 224/268 |
| 4,487,412 | 12/1984 | Meeko | 272/123 |
| 4,684,122 | 8/1987 | Desmond et al. | 272/143 X |

FOREIGN PATENT DOCUMENTS

| | | | |
|---|---|---|---|
| 0116670 | 8/1984 | European Pat. Off. | 272/119 |

OTHER PUBLICATIONS

Advertisement for "Conway Lat Strars", In Iron Man (Mag.), Jul. 1983, p. 61.

*Primary Examiner*—Richard J. Apley
*Assistant Examiner*—Robert D. Bahr
*Attorney, Agent, or Firm*—Gifford, Groh, Sheridan, Sprinkle and Dolgorukov

[57] ABSTRACT

A lift/tow assistance device to relieve the lower arm in sporting activities, particularly when strenuous, using equipments, which the user holds on particularly in equipment gymnastics, featuring a cuff for placing around the wrist, connected by a strap with a lock to a hook, which can be hung into the sporting equipment. In order to improve and further develop such a lift/tow assistance device so that it is not only easier to use but also ensure that it provides the user with optimum stress relief the strap lock is directly secured to the hook and is provided with a clamp lever which clamps the strap to a clamp plate of the lock when the strap is subjected to tension.

6 Claims, 2 Drawing Sheets

LIFT/TOW ASSISTANCE DEVICE TO RELIEVE THE LOWER ARM IN SPORTING ACTIVITIES USING EQUIPMENTS

BACKGROUND OF THE INVENTION

1. Field of the Invention

This invention relates to a lift/tow assistance device to relieve stress on the lower arm in sporting activities, particularly when strenuous, using equipment which the user holds onto, and more particularly in equipment gymnastics and water skiing, featuring a cuff for placing around the wrist, which cuff is connected to a hook by a strap with a lock, which cuff can be hung on the sporting equipment.

2. Description of the Prior Art

Lift/tow assistance devices of this kind are known from German Published Patent Specification No. 33 00 712 and U.S. Pat. No. 3,541,990. The essential feature of such lift/tow assistance devices is the use of a hook which, with the assistance of a cuff secured to the wrist, serves as a strain relief. For instance, an equipment gymnast, after having secured the cuff to his wrist, can hang onto a horizontal bar or chin up bar. It is understood that a cuff of this kind is attached to each wrist, one hand of the user gripping over the corresponding hook in the device. In this way each hook takes over the function of the hand in gripping the gymnastic equipment, thus relieving stress on the lower arm. This results in the connection between the equipment, which could be a horizontal bar for instance, and the user being maintained longer due to lesser stressing of the lower arm. Among other things, this has the advantage that the shoulder and back muscles can be stressed considerably longer than is normally possible when the user grips the bar merely by his hands.

The known lift/tow assistance device of the above mentioned kind has the disadvantage that the lock forms part of the strap, together with which it is movable with respect to the cuff, i.e. is capable of shifting and moving out of place all the time. It is thus left to the user to decide in which place the lock is to be arranged on the cuff, which can result in the lock not being in the centre of the cuff but rather at one of its ends. Since the cuff tighthens partly around the wrist, the said lock can thus only be opened or closed inconviently in such an extreme position when by the other hand of the user the assistance device is applied. In addition, in this known construction, the hook itself is not fixed with respect to the strap which means that the assistance device comprising hook, strap and cuff does not permit a fixed arrangement of the said three parts in relation to each other, so that time-consuming manipulations are required to find out the best position of the hook in relation to the other two parts.

Therefore, it is an object of the present invention to improve and further develop the known lift/tow assistance device of the above mentioned kind so that it is not only easier to use but also to ensure that it provides the user with optimum stress relief between the sporting appliance and the hand or arm, without necessitating time-consuming adjustments when applying the cuff, the result of which naturally can not be optimal.

It is another object of the present invention to provide a lift/tow assistance which offers better manipulation in applying and removing the device.

It is still a further object to improve stability and useful life of the lift/tow assistance device.

According to still another object of the present invention the lift/tow assistance device is to be provided with an arrangement eliminating the pressure point between the cuff and the lock.

SUMMARY OF THE INVENTION

According to the present invention, these and other objects are solved by the strap lock being directly secured to the hook and featuring a clamp lever which clamps the strap under stress to a clamp plate of the lock.

By this construction the strap lock is fixed in position in relation to the hook, thus assuming a non-shifting position with regard to the wrist or hand of the user, when the hand grips over the hook with the assistance device applied to the wrist. This arrangement of the lock also has the advantage that the strap lock is a part of the hook which can be produced together with the latter, in other words, no longer necessitating separate production. Moreover, the stresses between the hook and the lock need not be absorbed by a part of the strap, thus improving stability and useful life of this lift/tow assistance device. In conclusion, locating the strap lock on the hook also eliminates the pressure point between the cuff and the strap lock, which exists with the known cuff in that the strap lock is forced to act on the surface of the cuff and thus becomes uncomfortable for the user, if the cuff is not be well padded.

In accordance with one advantageous embodiment of the invention, provided that the hook is limited at its rear end by two edges abutting roughly at right angles to each other, the length of said edges being longer than the width of the strap which is connected to the hook in this area, the strap lock features a tongue projecting beyond one of the edges, said tongue being confined on both sides by cheeks located in the level of the tongue, said cheeks forming the bearing for two parallel pins, one of which carries the clamp lever free to swivel, whilst the other pin is part of the clamp plate. In this way the one end of the strap is clamped between the clamp lever and the clamp plate directly to the hook and can be easily released by swivelling the clamp lever to open the cuff when the assistance device is to be removed from the wrist.

In addition, good results have been obtained by providing the hook at its other edge with a slot running parallel to its edge and through which the other end of the strap is inserted and bent to form a fastening loop which is held by at least one rivet.

Generally the strap is slimmer than the cuff and connected to the latter loosely so that it passes through at least two loops formed in the cuff in the same way as a trouser belt.

In a further embodiment, strap and cuff can also form a single unit requiring, however, that a material is selected for the cuff which not only has adequate tensile strength but is also sufficiently soft to produce the effect of padding around the wrist and thus preventing the cuff from abreading the skin.

DESCRIPTION OF THE DRAWINGS

The invention is explained in greater detail on the basis of the example shown in the drawings.

DETAILED DESCRIPTION OF THE PREFERRED EMBODIMENT

Figure 1:
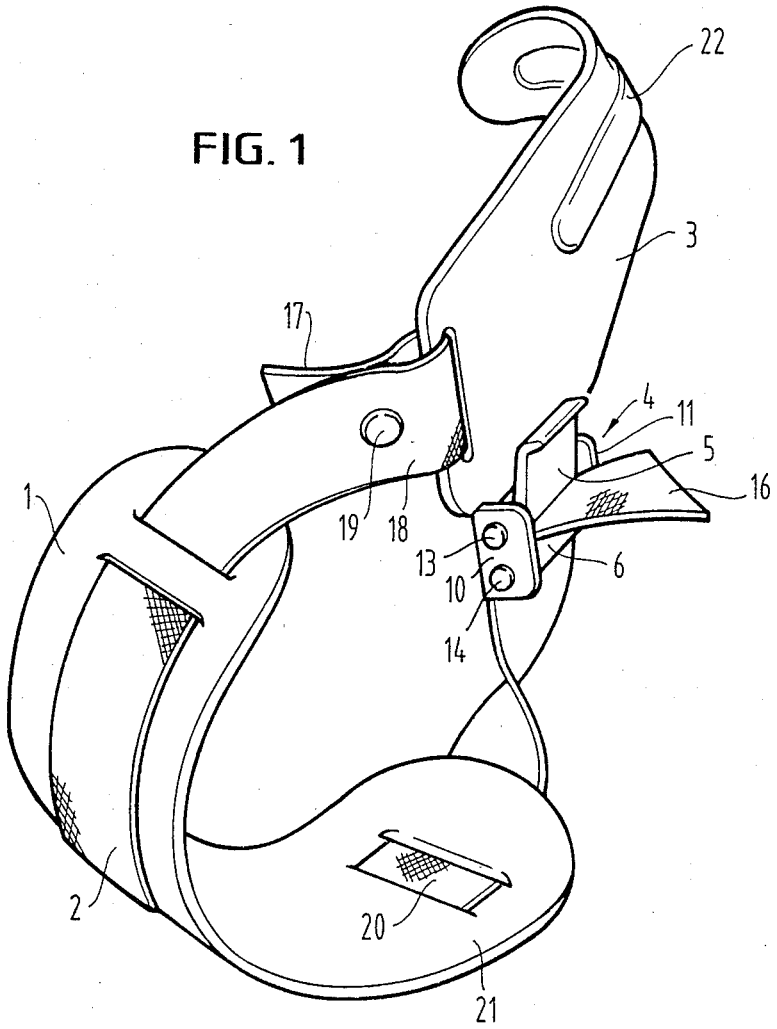
FIG. 1 shows the lift/tow assistance device in perspective.

The cuff 1, which can be of leather, for instance, is surrounded by a rugged strap 2, passing through the cuff by two loops 12, of which in FIG. 1 only the one on the left-hand end of the cuff can be seen, whilst the one on the right-hand end of the cuff can be recognized by the strap passing through the cuff at 20 being visible on the inside 21 of the cuff.

Figure 2:
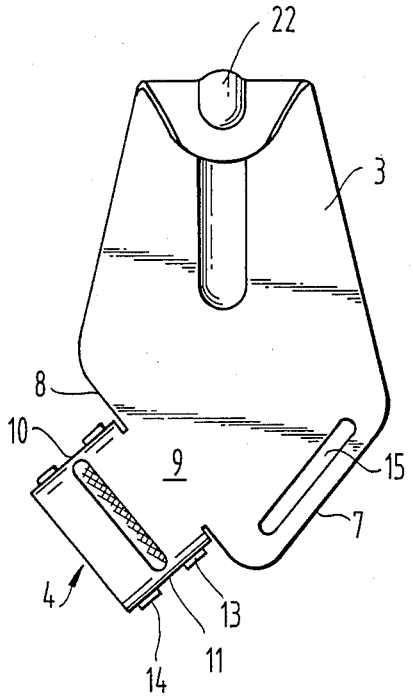
FIG. 2 shows a rear view of the hook with the strap lock as part of the hook.

The one end 16 of the strap passes through a strap lock 4, which is part of a hook 3 made of sheet steel, which at its rear end, as can be seen from FIG. 2, is confined by two edges 7, 8 abutting approximately at right angles to each other, the length of which is longer than the width of that of strap 2, which is connected to the hook 3 in this area. The front end of the hook is bent approximately 90° and reinforced by a crimp 22. With this end of the hook the user is able to hang onto a horizontal bar, for instance, as soon as he has applied the assistance device around his wrist.

The strap lock 4 features a tongue 9 protruding beyond the one edge 8, said tongue being located in the same plane as the hook surface, as shown in FIG. 2. On both sides of this tongue a cheek 10, 11 is standing on the plane of the tongue, and forming an integral part of the tongue. The two cheeks 10, 11 thus located opposite each other, form the bearing for two parallel pins 13, 13, of which the one pin 14 carries a clamp lever 5 free to swivel, while the other pin 14 is part of a clamp plate 6. Between the clamp lever 5 and the clamp plate 6, the end 16 of the strap is clamped in place. This arrangement is made so that a strap 2 subject to tensile stress causes a self-clamping effect of the strap lock 4 by the strap end 16 being clamped all the more, the higher the force introduced into the device.

While one edge 8 is provided with the strap lock 4, the other edge 9 has a slot 15 running parallel to it through which the other end 17 of the strap 2 passes, which other end is returned or bent to form a fastening loop 18 which is held in place by a rivet 19. In this way, strap and cuff form the body of the lift/tow assistance device which surrounds the wrist of the user. These can, in deviation from the drawing, also form a single unit, if the material, from which they are made, i.e. leather or plastic, possibly provided with glass-fibre reinforcement, is both capable of transmitting the tensile forces without tearing and providing padding for the human hand, thus preventing the cuff from abrading the skin.

The lift/tow assistance device described above can be used on any equipment, which the user holds by one or both hands by means of a handle or a bar. While, the physical forces of the user deminish after a relatively short time so that the grip of the hand loosens from the bar or the gripped portion of the apparatus, the user when using the described assistance device remains with his hand firmly attached to the corresponding holding cuff, and thus cannot slip off, so that painful injuries of the wrists or even dangerous falls need not be feared. in using this device the user is relieved by the hook 8 in such a way that an exercise for stressing the shoulder and back muscles can be carried out for a very long time without the user getting tired.

In this way the invention creates a means of assistance permitting an additional mechanical connection between a sporting equipment and the wrist by means of a hook, secured to the wrist with the aid of a cuff hang into the sporting apparatus. This assistance irrespective of whether or not the user grips the equipment with the fingers of his hand, fulfills an effective holding function, and because of the strap lock is a part of the hook, not only offers better manipulation in applying and removing the device, but also eliminates time-consuming adjustment procedures in fitting the cuff to the wrist, since the end of the strap which is not connected to the hook permits easier insertion into the lock where it can be clamped in position.

I claim:

1. A lift/tow assistance device for use with a bar of sporting equipment to reduce stress on a lower arm of a user of said device, said device comprising:

an elongated cuff member having a pair of end portions, said cuff member encircling a portion of a wrist of a said user;

a hook member having a curved portion extending from a rear portion, said curved portion adapted for hooking engagement with said bar of said sporting equipment;

a lock device rigidly mounted to said rear portion of said hook member, said hook device having an clamp plate and a clamp lever, said clamp plate being fixedly mounted to said rear portion of said hook member, means for rotatably mounting said clamp lever to said clamp plate so that said clamp lever being rotatable with respect to said hook device; and an elongated flexible strap connected to said cuff member, said flexible strap having a pair of ends, each of said pair of ends extending from a respective one of said pair of end portions of said cuff member; one of said pair of ends of said flexible strap being fixedly mounted to said hook member and the other of said pair of ends being demountably attached to said lock device in a predetermined orientation with respect to said hook member, said lock device clamping said other end of said strap when said strap is tensioned, and wherein said strap extends between the end portions of said cuff member.

2. The lift/tow device of claim 1, wherein said rear portion of said hook comprises a pair of edges extending at a generally right angle from each other, each of said pair of edges having a width greater than a predetermined width of said pair of ends of said strap, one of said pair of edges having a tongue portion extending along the plane of said rear surface, said lock device further comprising a pair of spaced apart check members and a pair of pins extending therebetween, said pair of cheek members being mounted to said tongue portion, said clamp plate being mounted to said one of said pair of pins and said clamp lever being rotatably mounted to an other of said pair of pins.

3. The lift/tow assistance device according to claim 2 wherein said rear portion of said hook member comprises a slot spaced apart and extending parallel to an other of said pair of edges, said one end of said strap being formed in a loop extending through said slot, said loop being affixed in position by at least one rivet.

4. The lift/tow assistance device of claim 1 wherein said cuff further comprises at least two spaced apart loops, said at least two loops being adapted to slidably receive said flexible strap therein.

5. The lift/tow assistance device of claim 1 wherein said strap and said cuff are formed in a single unit and of the same material.

6. The lift/tow assistance device of claim 1 wherein said hook member further comprises a crimp extending from said curved portion to said rear portion and wherein said curved portion extends at an angle of at least 90° to said rear portion.

* * * * *

UNITED STATES PATENT AND TRADEMARK OFFICE

CERTIFICATE OF CORRECTION

PATENT NO. : 4,807,876

DATED : Feb. 28, 1989

INVENTOR(S) : Lothar Eggerstorfer

It is certified that error appears in the above-identified patent and that said Letters Patent is hereby corrected as shown below:

On front of patent under UNITED STATES PATENT heading delete "Lothar and insert --Eggerstorfer--; On front of patent where it cites inventors name delete "Eggerstorfer Lothar" and insert --Lothar Eggerstorfer--;

Signed and Sealed this

Thirteenth Day of February, 1990

*Attest:*

JEFFREY M. SAMUELS

*Attesting Officer* *Acting Commissioner of Patents and Trademarks*